United States Patent [19]

Golick

[11] 4,247,974

[45] Feb. 3, 1981

[54] SET-UP METHOD FOR STEAM GENERATOR TUBE INSTALLATION APPARATUS

[75] Inventor: Leonard R. Golick, Penn Township, Burks County, Pa.

[73] Assignee: Westinghouse Electric Corp., Pittsburgh, Pa.

[21] Appl. No.: 952,433

[22] Filed: Oct. 18, 1978

[51] Int. Cl.[2] ..... B23K 31/00

[52] U.S. Cl. ..... 29/407; 228/103; 228/183

[58] Field of Search ..... 29/157.3 C, 157.3 R, 29/726, 727, 407; 228/103, 104, 105, 183

[56] References Cited

U.S. PATENT DOCUMENTS 4,042,161 8/1977 Anlo ..... 228/103

*Primary Examiner*—Carl E. Hall

*Attorney, Agent, or Firm*—L. A. DePaul

[57] ABSTRACT

Method and apparatus for expeditious installation of bottom-supporting and side-anchoring blocks for a tube and tube sheet bottom repair apparatus in the interior of the channel head of a steam generator at one side of the divider plate in a nuclear power plant, involving use of special tools and fixtures for location and welding of such blocks in position by use of information derived from measurement of the extent and direction of tilt of the tube sheet bottom from a purely horizontal attitude.

8 Claims, 9 Drawing Figures

SET-UP METHOD FOR STEAM GENERATOR TUBE INSTALLATION APPARATUS

CROSS-REFERENCE TO RELATED APPLICATIONS

The invention described herein is related to commonly assigned U.S. Patent application Ser. No. 888,701 filed Mar. 21, 1978 on Apparatus For Remotely Repairing Tubes In A Steam Generator by L. R. Golick; commonly assigned copending patent application Ser. No. 952,431 on A Method And Apparatus For Servicing A Steam Generator by Cooper and Castner, filed concurrently herewith; and commonly assigned copending U.S. Patent application Ser. No. 952,430 on Heat Exchanger Tube And Tubesheet Location Sensing Device And Method by Gerkey, Castner and Stiller, also filed concurrently herewith.

BACKGROUND OF THE INVENTION

This invention relates to nuclear steam generators and more particularly to a method and apparatus for set-up of a particular piece of equipment as disclosed in copending commonly assigned U.S. Patent application Ser. No. 888,701 filed Mar. 21, 1978 of L. R. Gollick directed to apparatus for remotely repairing tubes and/or the tube sheet in such a nuclear steam generator.

In pressurized water nuclear reactors primary fluid or coolant is pumped through a reactor and a steam generator, radioactive contaminants in the primary fluid are deposited on the tubes and in the channel head of the steam generator so that repair crews are subjected to significant radioactivity when working within the channel head. Therefore, in behalf of minimizing the exposure of personnel to radiation, apparatus and equipment of the type disclosed in the aforementioned copending patent application has been devised for inspection and repair of the tubes and the tube sheet within the steam generator under remote control, and in a manner as set forth in a copending patent application Ser. No. 952,431. It becomes important, in view of such minimal radiation exposure desirability, to provide for set-up of such equipment in minimal time, and to this the method and apparatus of the present invention is directed.

SUMMARY OF THE INVENTION

The method and apparatus of the present invention provides for rapid installation of a rotary support block member in the bottom spherical wall adjacent to the divider plate at the interior of the channel head of a nuclear steam generator undergoing tube repair. Which rotary bottom support member is intended for the lower-most end of a vertical column embodied in the tube repair apparatus of the aforementioned patent application Ser. No. 888,701. The present invention also involves installation of an anchor or pillow block member on the divider plate within the channel head adapted to accommodate attachment of a rotary column guide bracket at a selected vertical sight above the bottom support member for the column of the tube repair apparatus. On behalf of assuring trouble-free performance of the tube repair apparatus it becomes important that the bottom support bearing block member on the bottom wall of the channel head and the anchor block member on the divider plate be accurately positioned to provide for alignment of the column of the tube repair apparatus in an attitude of perpendicularity with respect to the tube-sheet in which the tubes undergoing repair are affiliated. To accomplish this in minimal time the apparatus in the method of the present invention determines and indicates the extent that the undersurface of the tube sheet is tilted from the horizontal by use of a special instrument introduced to the underside of the tube sheet and which includes a pair of commercially available inclinometers that give degree of tilt information in two mutually perpendicular directions readable via pick-off wires and a display at the exterior of the channel head.

Using a plumb-bob fixture that is adapted to be accurately positioned with respect to a specific hole in the tube sheet, a center punch mark is made on the bottom spherical wall of the channel head directly beneath the chosen hole sight.

By use of a center layouts template placed over the plumb-bob point on the bottom wall of the channel head locating marks for a positioning jig can be made on such bottom wall.

A positioning jig for the location of the bottom column bearing block is then placed on the bottom wall of the channel head in accord with such markings and tack-welded in place; the bottom column-bearing rotary-support block is then placed in the center of the positioning jig and centered by use of adjusting screws affiliated with such jig.

The bottom end of a vertical aligning post is then introduced into the bottom bearing block and locating pins at the top of the post are introduced into preselected holes in the bottom tube sheet by use of a hydraulic hand pump affiliated with such post to locate the upper end of the post in a selected site in the bottom of the tube sheet.

By use of a pair of inclinometers affiliated with the locating post and the adjusting screws on the positioning jig the bottom of the post can be moved in selected directions until accord is reached between the output of the aligning post inclinometers and the previous inclinometer output of the tilt determining instrument.

By application of additional pressure through use of the previously mentioned hydraulic hand pump, the bottom of the post can be made to introduce sufficient force to hold the bottom bearing block in place while it is then being welded to the bottom wall of the channel head.

Monitoring of the readings of the inclinometers on the post while performing such welding, together with utilizing a sequence welding technique, assures that the desired alignment of the post will not be disturbed during the welding of the bottom bearing block.

By use of a spring bias fixture mounted at a selected vertical location on the aligning post, the anchor block is positioned on the divider plate and held by spring pressure in position while being welded to such plate.

By use of a shim of selected size and proximity sensing heads disposed in a simulated rotary column guide bracket on the post, the gap between such simulated rotary column giode bracket and the anchor block welded to the divider plate can be determined with a high degree of accuracy.

By use of the hydraulic cylinder at the top of the column the aligning pins can be withdrawn from the locating holes in the tube sheet, the simulated rotary guide bracket on the post can be disconnected from the anchor block on the channel head by the simple withdrawal of a pair of coupling pins, and the aligning post assembly removed from the channel head by way of the usual manhole affiliated with such head.

The vertical column of the tube repairing apparatus can then be introduced through the manhole, its bottom end inserted into the bottom bearing block on the bottom of the channel head and the real rotary guide bracket for the column secured to the anchor block by reinsertion of the coupling pins and adjustment made for affecting precise alignment of such column perpendicularly with respect to the bottom of the tube sheet and along a selected rotary axis by introduction of a proper size shim between the anchor block and the guide bracket chosen in accord with information derived by the previous measurement of the clearance between the simulated bracket member and such anchor block.

DESCRIPTION OF THE PREFERRED EMBODIMENT

Figure 1:
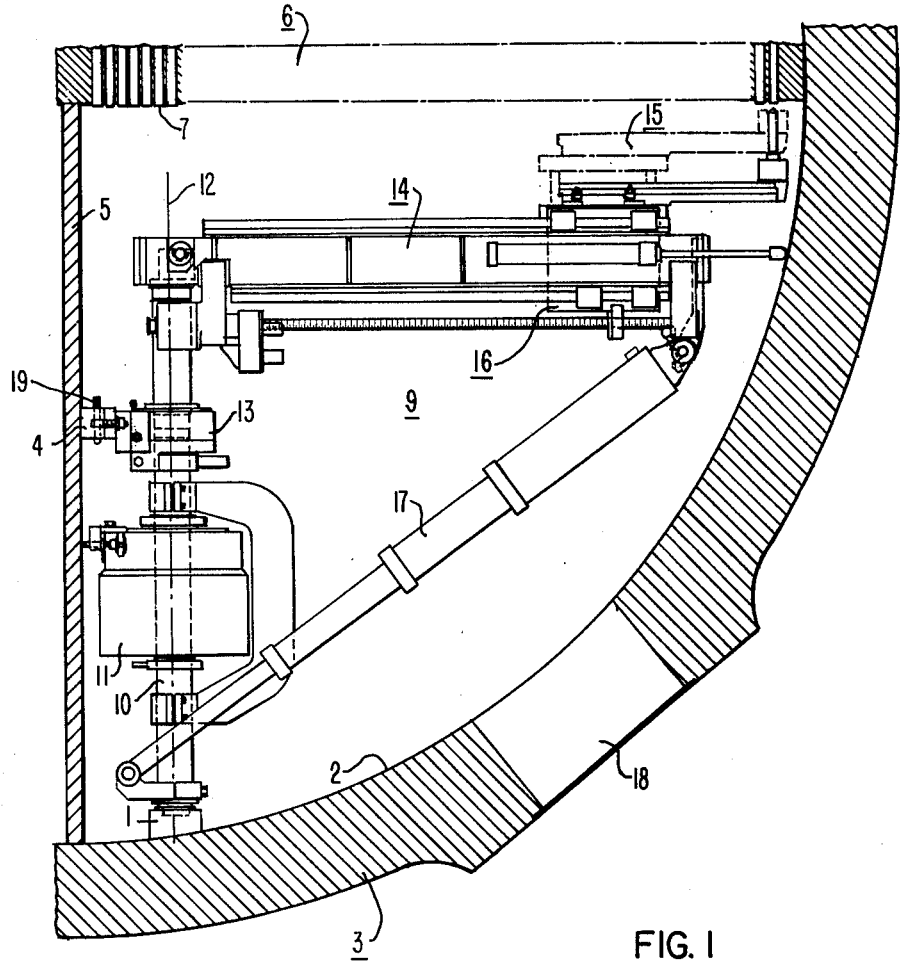
FIG. 1 is a vertical sectional view of a portion of a channel head of a steam generator with the tube and tube sheet reparing apparatus of copending patent application Ser. No. 888,701 disposed in working attitude therein.

Referring to FIG. 1, the present invention is concerned with installation of a bottom rotary support block 1 to the spherical bottom wall 2 of a channel head 3 of a nuclear steam generator and the location and attachment of an anchor block 4 to the divider plate 5 in such channel head beneath the bottom of the tube sheet 6 in which the terminal open ends of the vertical tubes 7 of the steam generator terminate. The bottom support block 1 and the side anchor block are utilized for alignment and support of a tube and tube sheet repairing apparatus 9 as shown in FIG. 1 and described in detail in aforementioned copending patent application Ser. No. 888,701 which apparatus utilizes a vertical column 10 supported at its lower end in the bottom bearing block 1 for rotation positioning by a motor 11 about a vertical axis 12 aligned with a particular tube hole in the tube sheet and extending perpendicularly from the bottom of such tube sheet by a rotary guide supbracket 13 removably attached to the anchor block 4. A horizontal boom 14 is pivotally carried at the top of the vertical column and supports a tool assembly 15 movable horizontally along the boom by way of a screw actuated carriage means 16. The boom is held in such horizontal position by a hydraulic cylinder assembly 17 operable to lower the boom to a retracted position adjacent to the column 10 and thereby realize a compacted state of the apparatus that affords its insertion and removal by way of the usual manway 18 affiliated with the channel head 3 of the steam generator. Removal of a pin 19 means affiliated with rotary guide bracket on the column provides for disconnection of the apparatus from the tube head.

The present invention is concerned with installation of the bottom bearing block 1 for the vertical column 10 of the tube repairing apparatus 9 and the anchor or pillow block 4 at one side of such column at a selected heighth thereon. It will be appreciated that, at such initial preparatory stage, the tube repair apparatus 9 depicted in FIG. 1 will be absent from the interior of the channel head as also will be the bottom support block 1 and the pillow block 4.

Figure 2:
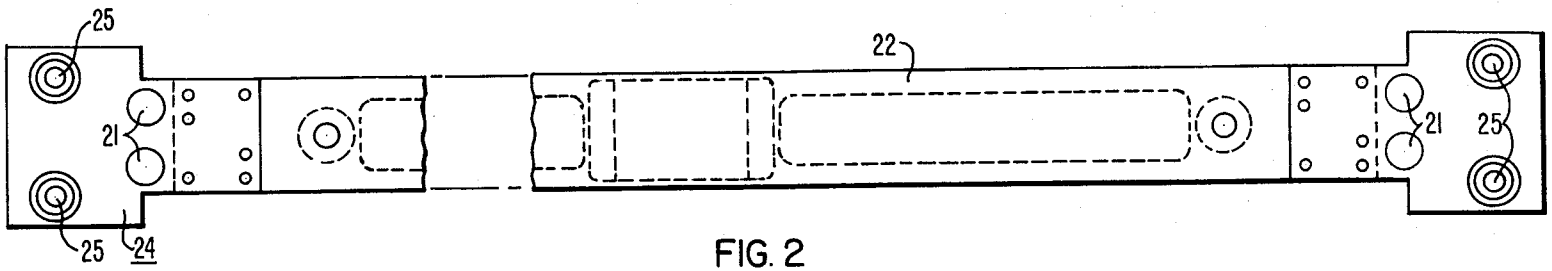
FIGS. 2 and 3 are top and side views, respectively of the tilt measuring instrument utilized in the present invention.
Figure 3:
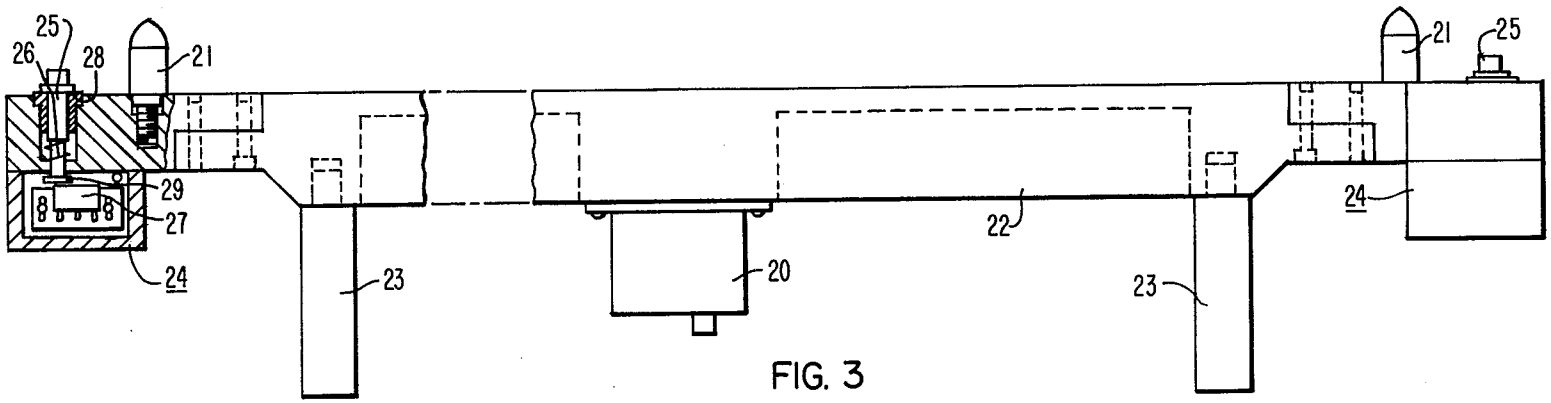

In accord with the present invention a worker or workers will enter the interior of the channel head 3 through the manway 18 and will use the tilt sensing instrument of FIGS. 2 and 3 to determine the degree of tilt of the bottom of the tube sheet 6 relative to the horizontal. Referring to FIGS. 2 and 3, the instrument is specifically adapted to this purpose and includes an inclinometer sensor means 20 adapted to feed signals to a digital readout located externally of the channel head by way of lead wires (not shown). The inclinometer sensor means 20 is capable of detecting the degree of tilt in mutually perpendicular directions in the horizontal plane and the instrument includes two pairs of horizontally spaced apart aligning pins 21 adapted for insertion in four tube holes opening downwardly from the bottom of the tube sheet. By proper selections of particular holes, the orientation of the instrument will be such that the tilt information derived from the inclinometer sensor means will be made with reference to a line extending centrally from and perpendicular to the divider plate 5. The instrument includes a horizontal arm 22 that carries such locating pins at its opposite ends as well as such inclinometer means at its midlength. The instrument also includes a pair of handles 23 to facilitate its manipulation during use and two pairs of pin-actuated interlock switch assemblies 24 at its opposite ends that operate to indicate when the arm of the instrument is parallel to the bottom surface of the tube sheet in the selected direction of extension of such arm. Each of the interlock switch assemblies includes an actuating pin 25 that has an end projecting upwardly from the top surface of the horizontal arm of the instrument and which is displaceable inwardly against the bias of a helical compression spring 26 by engagement with the undersurface of the tube sheet to actuate a microswitch 27 at the time a limit position defined by an annular shoulder 23 on the pin reaches its travel limit position. When the instrument is free of the tube sheet the extent of projection of the actuating pin is determined by a second annular stop surface 29 affiliated with the opposite end of such pin. The second annular stop surface may be formed in a removable part of the pin to accommodate assembly and disassembly.

The readings from the inclinometer tilt measuring instrument with respect to tilt of the tube sheet 6 in the x and y direction relative to the perpendicular line (not shown) extending from the divider plate 5 is noted and recorded for subsequent use.

Figure 4:
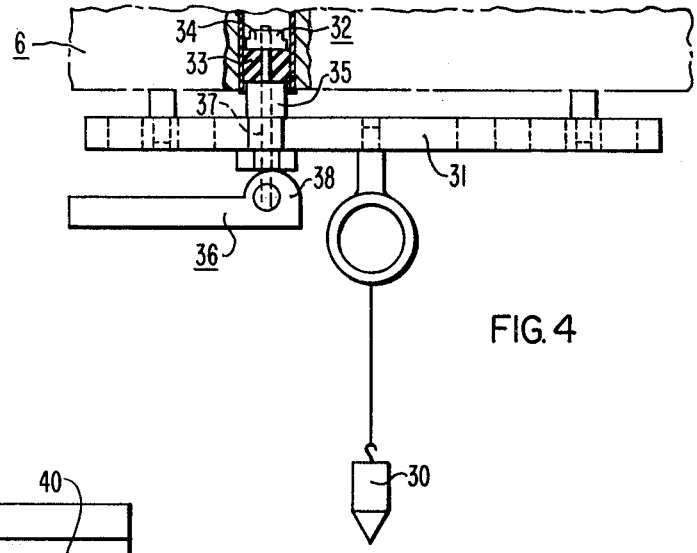
FIG. 4 is a elevation view of a plumb-bob device utilized in the invention of the present application.
Figure 7:
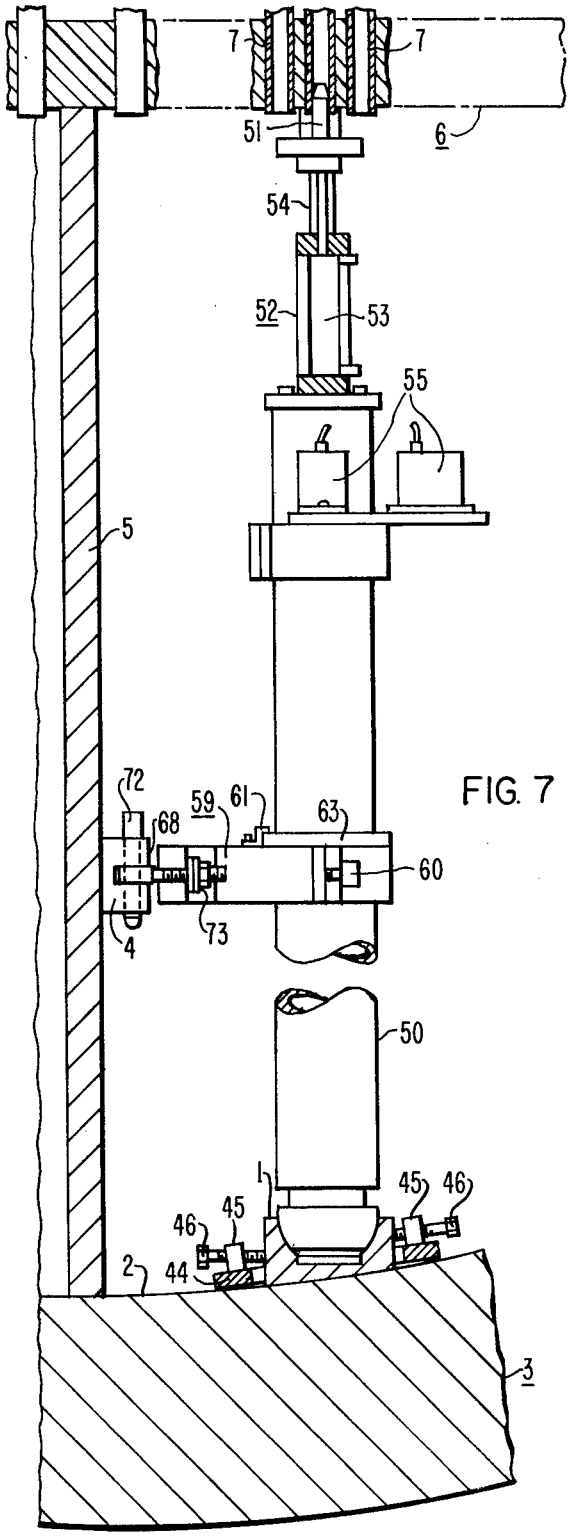
FIG. 7 is a vertical view of an aligning post assembly disposed in the steam generator channel head adjacent to the divider plate for location of the bottom column-bearing rotary support block and anchor block for the tube repairing apparatus of the aforementioned copending patent application Ser. No. 888,701, used in the present invention.

By use of a plumb-bob 30, FIG. 4, aligned with a particular tube hole or location on the tube sheet, a punch mark is made on the bottom wall 2, FIG. 7, of the channel head. Plumb-bob 30 forms part of an assembly including a horizontal arm 31 and a locating pin assembly 32 extending above the upper surface of the arm and adapted for insertion in a particular tube hole in the tube sheet. Such assembly includes a rubber portion 33 squeezed between rigid members 34 and 35 in an axialwise direction by operation of a rocking level 36 via a tension member 37 to cause such rubber portion to expand radially into friction locking squeezed engagement with the inner wall of the respective opening. The lever has a camlike portion 38 affiliated with it to enable such squeezing action on the rubber member to be established or disestablished according to direction of turning of the leaver.

Figure 5:
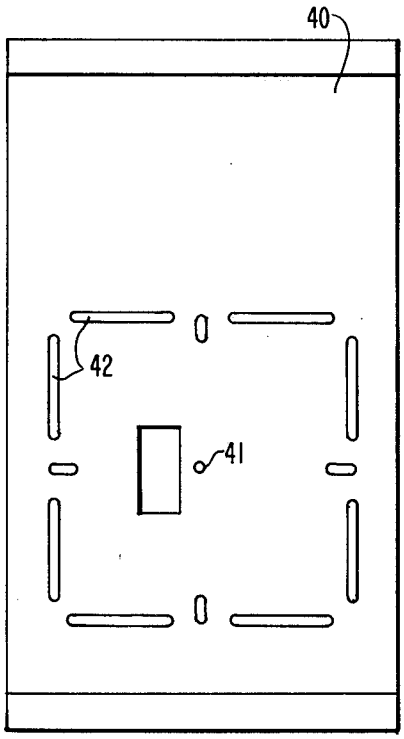
FIG. 5 is a plan view of a template used in the present invention.

Following such punch marking of the vertical alignment from the tube sheet on the spherical bottom wall 2 of the channel head a template 40 such is depicted in FIG. 5 having a center hold 41 is brought into registry with the punch mark and location markings are made on the wall by use of suitable location-marking openings 42 in the template.

Figure 6:
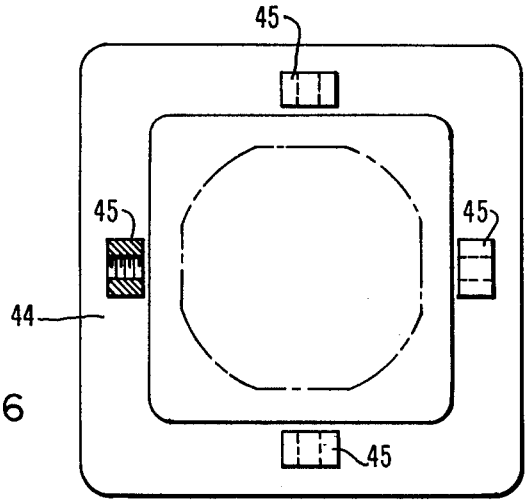
FIG. 6 is a plan view of a positioning jig utilized in the present invention.

A rectangular, open frame positioning jig 44, FIGS. 6 and 7, is centered and located on the markings on the channel head wall 2 and tackwelded in place. The jig has two pairs of spaced apart screw-threaded lugs 45 extending from its upper surface which are aligned along two mutually perpendicular directions, x and y. One of which is perpendicular to the divider plate surface and the other of which is parallel to such surface; it being appreciated that the desirable alignment is arrived initially by proper orientation of the template that was used to obtain the markings from which such positioning jig was located.

A bottom bearing block 1 is then inserted into the jig 44 and centered therein on the wall 2 by adjusting screws 46.

The lower end of a vertically extending aligning post 50, FIG. 7, is then inserted into the bottom 1 bearing block and a locating pin means 51 affiliated with a locating assembly 52 at the top end of the aligning post is introduced into a selected tube hole in the tube sheet by operation of a hydraulic cylinder 53 affiliated with such locating assembly. A guide pin means 54 is affiliated with such locating assembly that operates to assure that the selected rotary aligned position of the locating pin means with respect to the tube sheet 6 and to the divider plate 5 will apply also to the aligning post assembly generally, so that an inclinometer means 55 mounted near the top of such aligning post will be properly aligned with respect to the divider plate 5 to give x and y tilting information relative to a line extending perpendicular to such divider plate. While monitoring the output readings of the inclinometers on the aligning post, the bottom thereof is moved in unison with the bearing block 1 by selective turning manipulation of the adjusting screws 46 affiliated with the positioning jig until the inclinometer readings coincide with the previous readings obtained from the inclinometer means of the tilt measuring instrument; it being appreciated that the inclinometer means affiliated with the aligning post is so arranged as to be responsive to tilting of the column in a generally-horizontal plane perpendicular to the central vertical axis of such post.

While applying additional pressure to the hydraulic cylinder 53 at the top of the column such as by the use of the hand pump (not shown) the bottom of the aligning post is made to hold the bottom bearing block 1 tightly in place on the bottom wall of the channel head. The adjusting screws 46 are then backed off and the positioning jig freed from its tackwelding attachment to the channel head. The positioning jig is then raised free of the bottom block by upward movement along the aligning post and storage attachment thereto by such as taping.

While being so held against the bottom wall of the channel head the bearing block 1 is secured to the bottom wall by welding at the edges of the block in a manner which prevents shifting in the position of such block relative to the channel head. During such welding the output from the inclinometer means 55 at the top of the post can be monitored to detect any tendency for such shifting.

Figure 8:
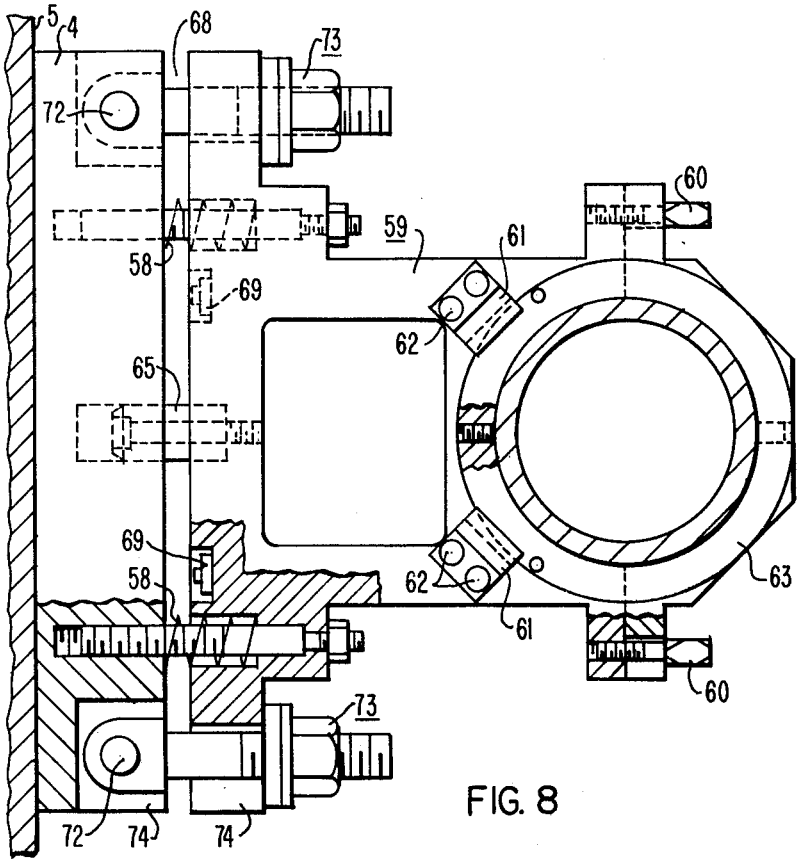
FIG. 8 is a plan view showing details of the simulated rotary column guide bracket affiliated with the alignment post and the rectangular anchor block affiliated with divider plate of the steam generator in which the present invention is utilized.

Having thus installed the bottom bearing block 1 onto the bottom wall of the channel head chamber the rectangular anchor or pillow block 4, FIGS. 7 and 8 is placed into position on the divider plate 5 and held in selected desired position by action of helical compression springs 58 affiliated with a simulated rotary guide bracket assembly 59 clamped to the aligning post by a pair of quarter-turn screws 60 and located at the desired vertical height on such aligning post by a pair of alignment tabs 61 removably secured to such guide bracket in a selected rotary position on the post by screws 62. The tabs are slideable on the upper surface of a locating collar 63 on the rotary guide bracket which has a sliding fit with the outer periphery of the aligning post to provide frdeedom for sidewise position-adjusting movement of the anchor or pillow block 4 while abutting the divider plate. The extent of such adjusting movement is limited and once the proper position is obtained the rotary guide bracket can be clamped in place by tightening the mounting screws 62. A master dowell pin 65 cooperating between the anchor block and the guide bracket maintains centering relationship between these two members. While thus being held in place by the action of the helical compression springs 58 of the guide bracket, the anchor or pillow block 4 is welded to the wall of the divider plate 5.

Figure 9:
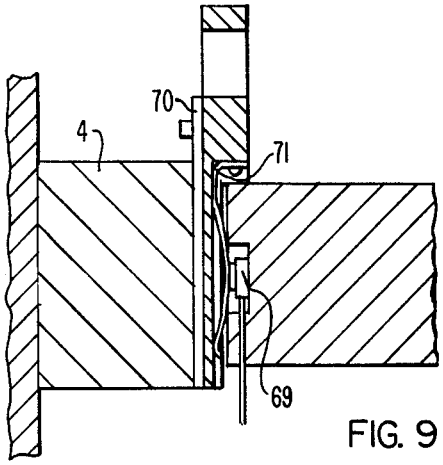
FIG. 9 is a vertical section view showing details of a shim assembly involved in the gap measuring step of the present invention.

Referring to FIGS. 7, 8, and 9, the horizontal gap 68 between the anchor or pillow block 4 attached to the divider plate and the adjacent end of the simulated rotary guide bracket 59 is measured by a pair of proximity sensors 69 in the end face of such bracket, a suitable sensor being such as the Kaman sensor number 2UB bonded in place in a cavity in the end face of such guide bracket. To suit the operating ramge of the sensors, a shim means 70 of known thickness may be introduced into the gap in a region of the sensors and held in place against the gap-defining face of the pillow block 4 by a leaf spring clip 71 attached to the shim and abutting the corresponding face of the forward end of the guide bracket. The gap width is then arrived at by adding the thickness of the shim 70 to the reading from the sensors 69. This information is subsequently utilized to determine the thickness of a shim means (not shown) to be introduced between such pillow block and the rotary guide bracket 13 affiliated with the vertical column 10 of the tube repair apparatus with which such pillow block is intended to be affiliated. It being appreciated that the simulated rotary guide bracket 59 attached to the aligning post 50 is similar in critical dimensions to the corresponding rotary guide bracket 13 affiliated with the vertical post 10 of the tube repair apparatus so that the gap measuring can be translated directly into thickness of the mounting shim for such apparatus.

Finally, the aligning post 50 together with bracket 59 can be freed from the tube sheet by retraction of the locating pins by operation of the hydraulic cylinder 53 in the locating assembly atop such post and from the anchor or pillow block now welded to the divider plate by removal of coupling pins 72 that connect such block at opposite end to the guide bracket 59 through the medium of adjustable stop pin assemblies 73 disposed in end slots 74 of such guide bracket. Such arrangement enabling initial installation of an anchor block 4 to the bracket 59 by connecting the adjustable stop pin assemblies 73 to the block by the coupling pins 72 and then swinging the adjustable stop pin asemblies sideways into the end slots 74 of the bracket 59, with springs 58 in place. The installation of the anchor, or pillow block 4 together with the bottom bearing block 1 within the channel head chamber is now complete, in accord with the objectives of the present invention, and the aligning post assembly can then be removed from such interior chamber by way of the manway 18.

While the invention has been shown and disclosed herein in what is conceived to be a practical and preferred embodiment, it is recognized that departures may be made therefrom within the scope of the following claims.

I claim:

1. A method of installing a bottom support block and a side anchor block for an apparatus support column to be located at the interior of the channel head at a particular tube sheet bottom site adjacent to the divider plate and in extension perpendicularly to the tube sheet bottom in a steam generator, comprising the steps of measuring the tilt of the aforesaid tube sheet bottom, establishing a channel head wall site on the interior bottom wall of the channel head directly beneath the aforesaid tube sheet bottom site, erecting an elongated alignment member vertically between the aforesaid tube sheet bottom site and the channel head wall site and in support by the aforesaid bottom support block, relocating the bottom support block by establishing correspondence between information from a tilt sensor means on the alignment member and that relating to the tube sheet bottom, welding said bottom support block in place at its relocated site, introducing the side anchor block to the divider plate at one side of said alignment member at a particular vertical location thereon and rotary alignment thereof, welding said anchor block in place on the divider plate, measuring the gap between said secured anchor block and a fixture on said alignment member, and removal of such alignment member.

2. The method of claim 1, wherein an open-frame adjusting-screw-laden positi ning jig is tack-welded to the channel head wall for cooperation with said bottom support block as a means of effecting the aforesaid relocating thereof.

3. The method of claim 1, wherein a plumb-bob fixture lockable onto the tubesheet bottom is used for establishing the aforesaid channel head site.

4. The method of claim 1, wherein the aforesaid fixture on said alignment member is dimensioned and located so that the measured gap information can be translated directly into thickness of a shim for precise mounting of a rotary guide support bracket for the aforesaid apparatus support column.

5. The method of claim 4, wherein said fixture on said alignment member is also utilized for support and location of said anchor block at time of its introduction and welding to the divider plate.

6. The method of claim 5, wherein said fixture includes a spring bias means to obtain a force for holding said anchor block in place during welding.

7. The method of claim 1, wherein the tube sheet bottom tilt information is obtained by use of an instrument that includes a means for detecting when such instrument is disposed in proper measuring position on the tube sheet bottom.

8. The method of claim 1, wherein measurement of tilt of the tube sheet bottom is obtained by use of a tilt-sensor-laden instrument adapted for precise orientation and location on said tube sheet bottom.

* * * * *